US006686812B2

(12) United States Patent
Gilbert et al.

(10) Patent No.: US 6,686,812 B2
(45) Date of Patent: Feb. 3, 2004

(54) MINIATURE DIRECTIONAL COUPLER

(75) Inventors: William C. Gilbert, Phoenix, AZ (US); Bogdan M. Izdebski, Peoria, AZ (US); William H. Brettner, III, Goodyear, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/154,298

(22) Filed: May 22, 2002

(65) Prior Publication Data

US 2003/0218516 A1 Nov. 27, 2003

(51) Int. Cl.[7] ..... H01P 5/12; H01P 5/18
(52) U.S. Cl. ..... 333/112; 333/116
(58) Field of Search ..... 333/112, 119, 333/116, 25, 26, 111; 336/200, 180, 184, 183, 182

(56) References Cited

U.S. PATENT DOCUMENTS

| | | | | |
|---|---|---|---|---|
| 3,164,790 A | | 1/1965 | Oh | |
| 3,833,872 A | * | 9/1974 | Marcus et al. | 336/83 |
| 5,313,175 A | | 5/1994 | Bahl et al. | |
| 5,499,442 A | | 3/1996 | Nakamura et al. | |
| 5,532,667 A | * | 7/1996 | Haertling et al. | 336/177 |
| 5,689,217 A | | 11/1997 | Gu et al. | |
| 5,841,328 A | * | 11/1998 | Hayashi | 333/116 |

FOREIGN PATENT DOCUMENTS

| | | |
|---|---|---|
| EP | 0439928 A | 8/1991 |
| EP | 0671776 A | 9/1995 |
| EP | 0763868 A | 3/1997 |

OTHER PUBLICATIONS

JP07283622A (Murata Mfg Co Ltd), Oct. 27, 1995 –abstract, figure 2, Patent Abstracts of Japan, vol. 1996. No. 02, Feb. 29, 1996.

JP05243820A (Murata Mfg Co Ltd), Sep. 21, 1993 –abstract, figures 1 and 3, paragraph '00191!, Patent Abstracts of Japan, vol. 017, No. 706 (E–1483).

* cited by examiner

*Primary Examiner*—Robert Pascal
*Assistant Examiner*—Dean Takaoka

(57) ABSTRACT

A layered directional coupler including conductive traces placed along predetermined axes for making contact with main and auxiliary signal lines. The axes are positioned at predetermined angles relative to each other to maximize the area for making contact thereto, which minimizes the size of the directional coupler. Ground planes are used to minimize parasitic coupling between the traces. The main and auxiliary signal lines are provided by inductively coupled juxtapositioned spiral coils which coupling maximize the characteristics of the coupler.

19 Claims, 5 Drawing Sheets

MINIATURE DIRECTIONAL COUPLER

FIELD OF THE INVENTION

The present invention relates in general to directional couplers and more specifically to directional couplers that have minimal dimensions.

BACKGROUND OF THE INVENTION

As will be more completely described herein, a directional coupler is a linear, passive, multi port network, consisting of a pair of electromagnetically coupled signal conducting "lines" or structures such as strip lines or transmission lines. One of the pair of lines is a "main signal line" that connects an input port of the coupler to an output port. The other of the pair of lines is an "auxiliary signal line" that is connected to at least one measurement or utilization port. The auxiliary line is coupled to the main line through a "coupling region" where the lines are in close proximity to each other. A radio frequency (rf) signal applied to the main line induces a signal in the auxiliary line. Maximum signal coupling between the pair of coupled lines is achieved when the length of the coupling region is an odd multiple of a quarter wavelength of the signal traveling on the main line. This attribute results in the efficient operation of a coupler having a coupling region of a given length being limited to a particular bandwidth.

Accordingly a directional coupler can perform as a measurement tool that samples a small portion of the radio frequency energy traveling through the main line between a signal source and a load, for instance. This energy can travel "forward" from a signal source such as a transmitter to a load such as an antenna and/or the energy can be reflected in "reverse" from the antenna to the transmitter.

There are 3-port unidirectional couplers and 4-port bi-directional couplers. The unidirectional coupler consists of a main line and an auxiliary line, which can be internally terminated in the coupler at one end with the other end providing the coupled output. It is necessary to physically reverse the unidirectional coupler to individually measure the forward and reverse signal powers one at a time. The bidirectional coupler is similar to the unidirectional coupler with the exception that both ends of the auxiliary line provide coupled outputs. Thus the bi-directional coupler can be used for simultaneously monitoring both the forward and the reflected power.

Forward transmitter power may be monitored to determine transmitter output power and efficiency. Reflected transmitter power may be monitored to determine the state of the output transmission cable and the associated antenna. The radio communication system performance is proportional to the antenna efficiency. Comparison of the forward and the reflected powers provides a metric of communication system performance. "Transmission Efficiency", which is proportional to the ratio of the power coupled out in the forward direction to the power reflected back in the reverse direction, is dependent on the magnitude of the impedances of the electrical loads at the ports of the directional coupler.

Directional couplers are employed in a variety of electronic applications. There is a need to minimize the size and weight of such couplers which are permanently mounted in avionics or portable equipment, for example. Prior art parallel strip line couplers are sometimes laid out on printed wiring boards having straight, closely spaced conductive traces utilizing long parallel lengths to provide the coupling region. As mentioned the physical size of such couplers is a function of the wavelength of the coupled signal. These strip line couplers are useful for some applications but tend to be too long for permanent installation in avionics and portable products because of the length of the coupling regions thereof.

Accordingly other prior art directional couplers have been developed that require careful hand placement of delicate, vendor-supplied, wire wound components, which provide shortened coupling regions. Such couplers have been permanently installed in avionics equipment. A traditional engineering mandate is to reduce the number of such components requiring manual assembly.

Still other prior art couplers include main and auxiliary spiral windings in a face-to-face, mirror image planar relationship with each other. Such structures tend to result in an undesirable amount of capacitive coupling between the windings, which causes the amount of coupling to undesirably increase with frequency. It is desired for the amount of coupling to remain as constant as possible over the bandwidth of operation. Moreover such prior art structures are required to have undesirably large dimensions to facilitate electrical connection of conductive traces to the ends of the windings. Furthermore such structures can tend to allow parasitic coupling between the traces which also tends to undesirably distort the coupling characteristic over the bandwidth of operation.

Accordingly there is a need for economical directional coupler structures, which have minimal space and weight requirements that are suitable for permanent installation in aviation and portable communication systems. Also it is desirable for such couplers to provide minimal insertion losses and maximum coupling efficiencies. Additionally it is desired to provide couplers which have a constant coupling sensitivity over the bandwidth of operation and which minimize parasitic coupling. Moreover it is desirable to provide ruggedized, reliable coupler structures which don't require hand placed or vendor supplied parts and which are easy to manufacture.

BRIEF DESCRIPTION OF THE DRAWING FIGURES

The subject matter of the present invention is particularly pointed out and distinctly described in the following portions of the specification. The invention, however, both as to organization and method of operation, may best be understood by reference to the following description taken in conjunction with the accompanying drawing in which like parts may be referred to by like numerals.

Figure 2:
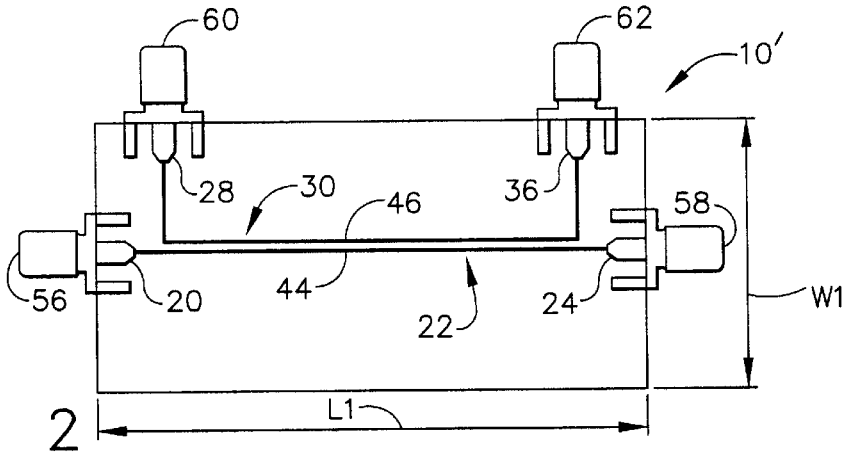
FIG. 2 (PRIOR ART)
FIG. 2 depicts a prior art bidirectional coupler structure having undesirably large dimensions for some applications.
Figure 3:
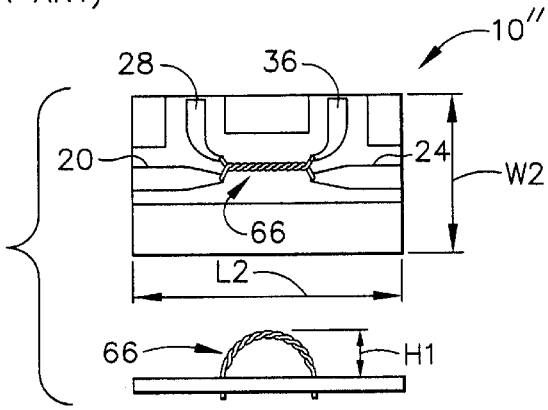
FIG. 3 (PRIOR ART)
FIG. 3 illustrates a prior art bi-directional coupler structure having a delicate, wire wound component.
Figure 11:
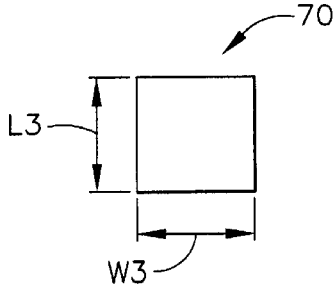
Figure 4:
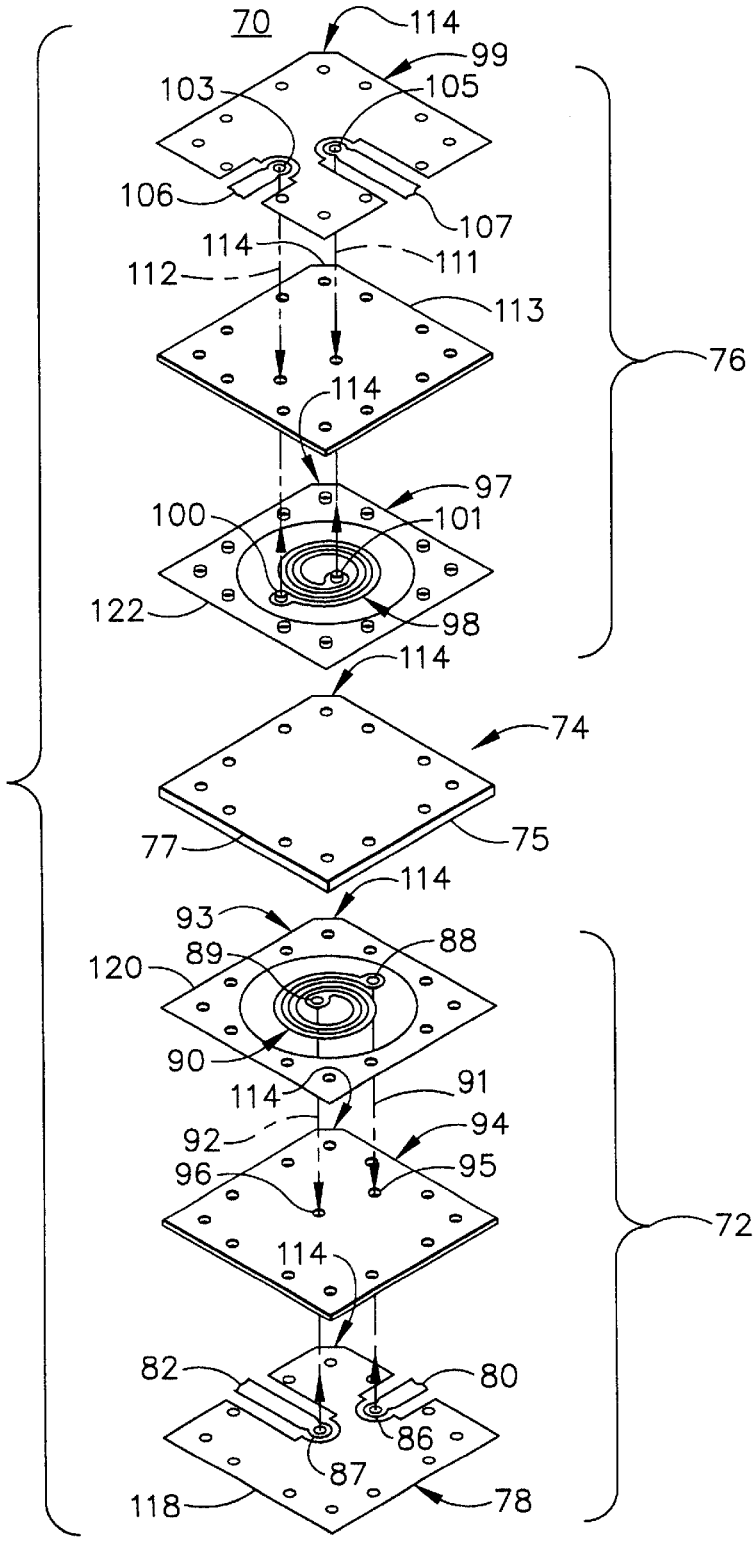
Figure 5:
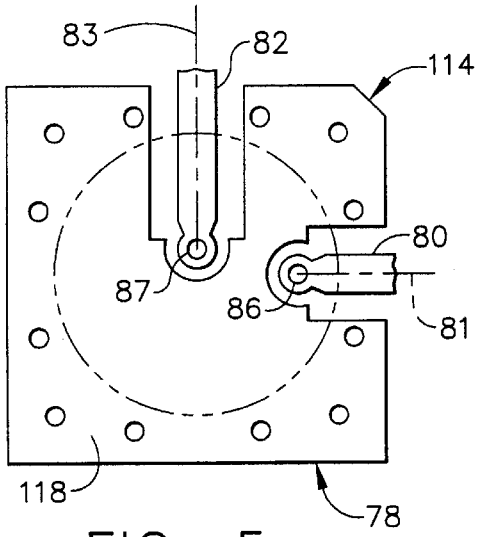
Figure 6:
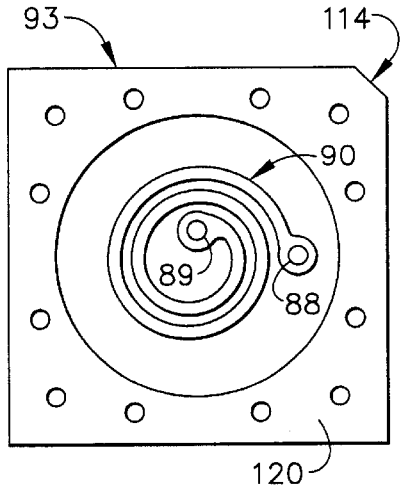
Figure 7:
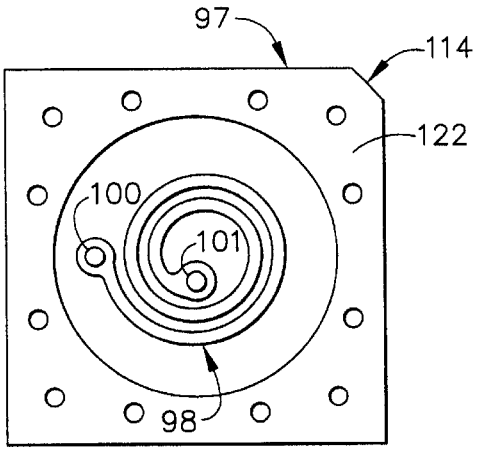
Figure 8:
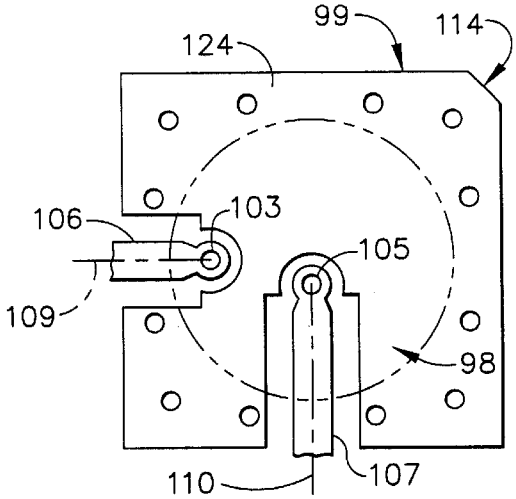
Figure 9:
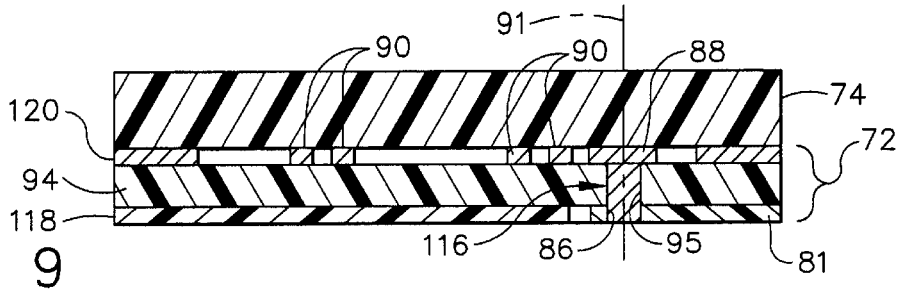
Figure 10:
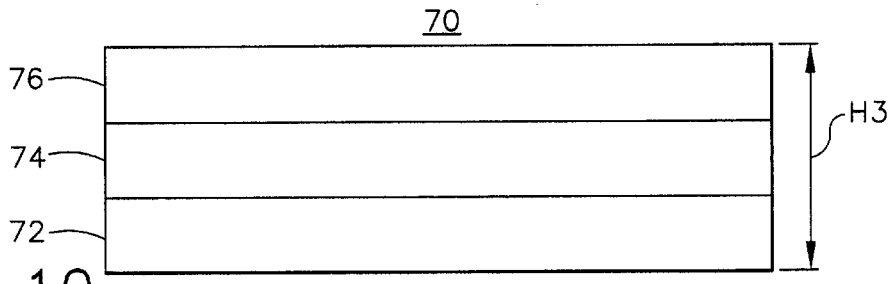
Figure 12:
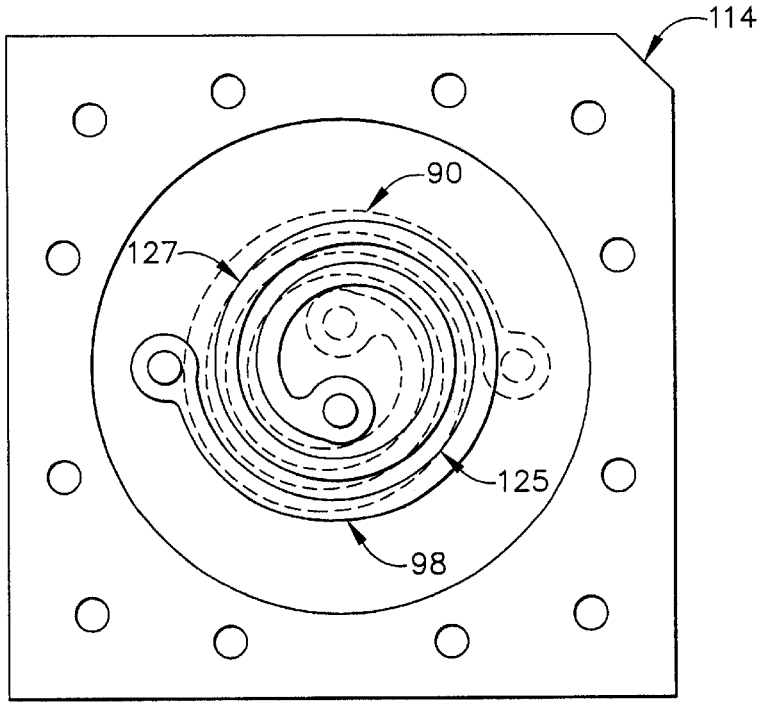
Figure 13:
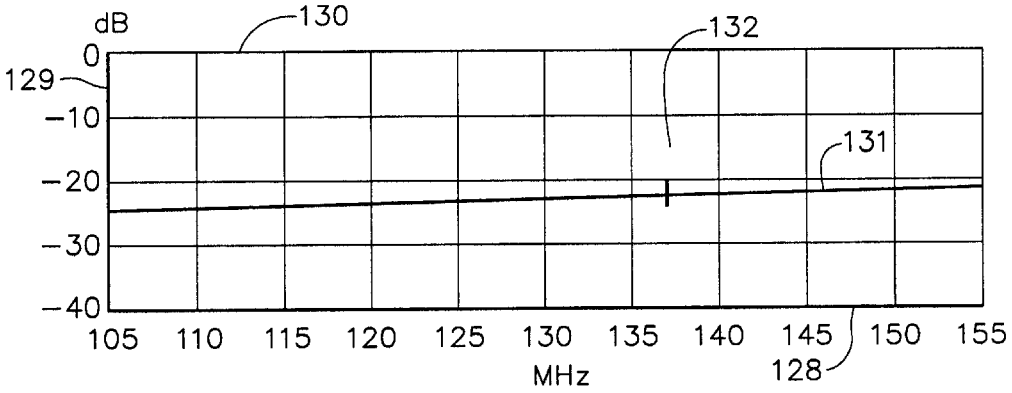
Figure 14:
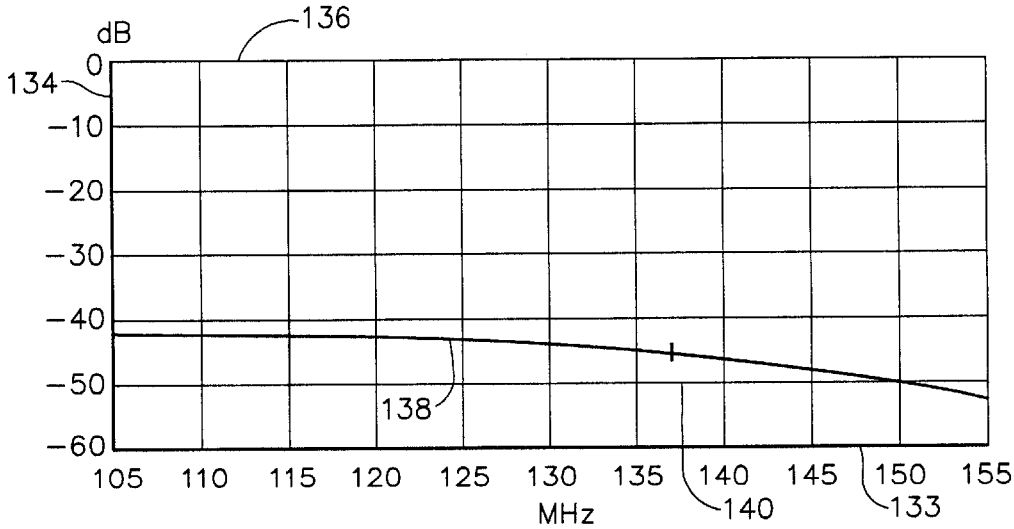

FIG. 4 provides an exploded view of a multi-layer directional coupler structure of one embodiment of the invention;

FIG. 5 shows the conductive tab structure associated with the bottom layer of the coupler of FIG. 4;

FIG. 6 shows the spiral winding on the top surface of the bottom member of the coupler of FIG. 4;

FIG. 7 shows the spiral winding on the bottom surface of the top member of the coupler of FIG. 4;

FIG. 8 shows the conductive tabs on the top surface of the coupler of FIG. 4;

FIG. 9 shows a cross section of the coupler of FIG. 4 which illustrates an exemplary connection between conductive layers thereof;

FIG. 10 shows a non-exploded view of the multi-layer structure of FIG. 4;

FIG. 11 is a top view of the structure of FIG. 10 which facilitates comparison of the relative dimensions of the structure of one embodiment of the invention to the prior art structures of FIG. 2 and FIG. 3;

FIG. 12 is a top view of the juxtapositioned spiral windings of the structure of FIG. 4;

FIG. 13 shows the forward coupling characteristic of at the forward auxiliary port of a directional coupler of an embodiment of the invention; and FIG. 14 shows the forward coupling characteristic of a directional coupler at the reverse auxiliary signal port of an embodiment of the invention.

DETAILED DESCRIPTION OF THE DRAWINGS

The subject matter of the present invention is particularly suited for use in connection with communications systems for use in aircraft and avionics, which are, required to take a minimum of space and to have a minimum weight. As a result, the preferred exemplary embodiments of the present invention are described in that context. It should be recognized, however, that such description is not intended as a limitation on the use or applicability of the present invention, but is instead provided merely to enable a full and complete description of a preferred embodiment. For example, the present invention may be also applied to couplers for use in portable or hand-held communication systems.

Figure 1:
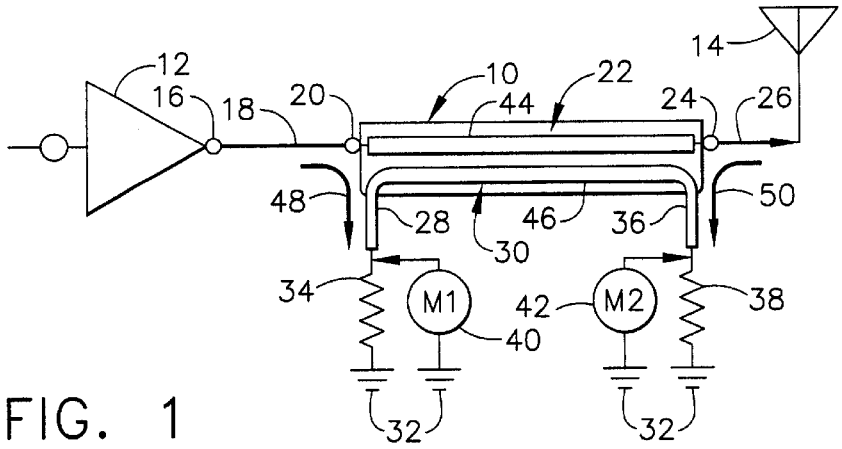
FIG. 1 illustrates a schematic diagram of a bi-directional coupler connected to measure the forward and reverse signal powers associated with a rf signal source and a load.

FIG. 1 illustrates a schematic diagram showing a generalized application of bidirectional coupler 10 connected to measure the forward and reverse signal powers associated with rf signal source 12 and antenna 14. More specifically, power source 12 can be the output amplifier of a 25 watt aircraft transmitter having an output terminal 16 coupled through input transmission line 18 to input port 20 of main signal line 22 of coupler 10. Output port 24 of main line 22 is coupled through output transmission line 26 to aircraft antenna 14. Forward signal monitoring or utilization port 28 of auxiliary line 30 is connected to ground 32 through resistor 34. Similarly, reverse signal monitoring or utilization port 36 of auxiliary line 30 is connected to ground 32 through resistor 38. Forward power meter 40 is connected across resistor 32 and reverse power meter 42 is connected across resistor 38.

The parallel portions 44 and 46 of respective lines 22 and 30 provide a "coupling region" facilitating the electromagnetic coupling of signals from main line 22 into auxiliary line 30. More specifically, in response to a forward rf input signal having a power of 25 watts being applied to line 22 by amplifier 12 a portion of this forward power, as indicated by arrow 48, having a magnitude of 200 milliwatts for instance will be induced through coupling region portion 46 and applied to resistor 34 and measured by meter 40. As a result, most of the forward power will be applied by main line 22 through transmission line 26 to antenna 14.

However any mismatch in the impedances at ports 20 and 24 will result in a portion of the forward power being reflected back from port 24 to provide reverse power. The greater the mismatch the greater the magnitude of the reverse power. A portion of the reverse power of less than 2.5 milliwatts, for instance, is electromagnetically coupled to coupling region 46 and applied through port 36 to resistor 38, as indicated by arrow 50, and measured by meter 42. The ratio of the forward power measured by meter 40 to the reverse power measured by meter 42 provides a metric proportional to the efficiency of the power transfer from amplifier 12 to antenna 14.

FIG. 2 is a top down view of prior art directional coupler structure 10' for use in the aircraft communication band of 105 Megahertz (MHz) to 155 MHz. Etching the top surface of a strip line board forms the main and auxiliary lines 22 and 30. The reference numbers from the description of FIG. 1 are used to identify the corresponding structures of FIG. 2. Rf connectors 56, 58, 60 and 62 are connected to respective ports 20, 24, 28 and 36. Length, L1 of coupler 10' is 2.7750 inches and width, W1 is 1.425 inches. Since length L1 of coupler 10' is much shorter than a quarter of a wavelength at the center frequency of operation, coupler 10 is referred to in the art as being "electrically short". Although coupler 10 is useful for performing tests on avionics and portable communications systems the dimensions of coupler 10' are undesirably large for permanent installation of coupler 10' in such equipment.

FIG. 3 is a top down view of another prior art directional coupler 10" for use in the aviation communication band, and which has much smaller dimensions than coupler 10'. More specifically, length, L2 of "electrically short" coupler 10" is 1.35 inches and width, W2 is 0.8 inches. Again common reference numbers are used in FIGS. 1, 2 and 3 to designate corresponding structures. The coupling region of coupler 10" is provided by a delicate, vendor-supplied, wire wound component 66, which must be hand or manually placed in coupler 10". The height, H1 of component 66 is 0.26 inch. Although the dimensions of coupler 10" are smaller than those of 10' the use of component 10" is undesirable from the viewpoints of manufacturing costs, reliability and ruggedization because of coil 66.

FIG. 4 shows an exploded view of an exemplary embodiment of bi-directional spiral coupler 70 in accordance with the invention. Coupler 70 includes first or bottom member 72, center or middle member 74 and second or top member 76.

More particularly, member 72 includes a bottom layer comprised of a conductive copper strip line ground plane 78 which is patterned to provide tabs or traces 80 and 82. As shown in FIG. 5 trace 80 is provided along a first horizontal axis 81 and trace 82 is provided along a second horizontal axis 83. Axes 81 and 83 are at a 90 degree angle with respect to each other. Traces 80 and 82 include respective end portions or terminals 86 and 87 for making electrical connection to respective end terminals 88 and 89 of spiral coil 90 of FIG. 6. Vertical axis 91 of FIG. 4 indicates the alignment of terminals 86 and 88 and vertical axis 92 indicates the alignment of terminals 87 and 89. Coil 90 is etched into conductive ground plane layer 93 of member 72. A first or main signal line performing the function of line 22 of FIG. 1 can be provided by coil 90, for instance. Coil 90 could be a segmented straight-line equivalent of a spiral.

Insulating substrate layer 94 of FIG. 4 separates conductive layers 78 and 93. Layer 94 has bottom and top planar surfaces respectively affixed to conductive layers 78 and 93. Holes 95 and 96 are provided through layer 94 so that tab terminals 86 and 87 can be connected to respective coil terminals 88 and 89. More specifically as will be described with respect to FIG. 9, a conductor is plated through hole 95 that is aligned with axis 91 to connect tab terminal 86 of FIG. 5 to coil terminal 88 of FIG. 6. Another conductor is plated through hole 96 that is aligned with axis 92 to connect tab terminal 87 to coil terminal 89. Such conductors are provided in a similar manner, which is well known in the art.

Center substrate member 74 of FIG. 4 is comprised entirely of an insulating material having bottom planar surface 75 and top planar surface 77. Surface 75 is affixed to the top planar surface of layer 93.

Top member 76 of FIG. 4 includes a bottom conductive layer 97 having spiral coil 98 of FIG. 7 provided thereon. Coil 98 also could be a segmented straight line equivalent of a spiral. Layer 97 is affixed to surface 77 of substrate 74. Coil 98 can be utilized to provide auxiliary signal line 30 of FIG. 1 for instance. Top surface 99 of member 76 is comprised of a copper strip line ground plane which is patterned to accommodate plated through conductors associated with terminals 100 and 101 at the ends of coil 98 for making electrical connection to the respective end terminals 103 and 105 of respective tabs or traces 106 and 107 of FIG. 8. Traces 106 and 107 are etched into conductive upper layer 99. Tab 106 extends along horizontal axis 109 and tab 107 extends along horizontal axis 110 of FIG. 8. Axes 109 and 110 are at a 90-degree angle with respect to each other.

Vertical axis 111 of FIG. 4 indicates the alignment of coil terminal 101 and tab terminal 105 and vertical axis 112 indicates the alignment of coil terminal 100 and tab terminal 103. Insulating substrate layer 113 of FIG. 4 separates patterned layers 97 and 99 of top member 76. Layer 113 has bottom and top planar surfaces that are respectively affixed to layers 97 and 99.

Trace axes 81 and 83 are perpendicular to the tangent of spiral 90 at respective points of contact 88 and 89. Similarly, trace axes 109 and 110 are perpendicular to the tangent of spiral 98 at respective points of contact 100 and 101.

Notches 114 on the corners of each of the layers of coupler 70 can be utilized to enable alignment of such layers during the manufacturing process.

It is apparent from FIGS. 4, 5 and 7 that traces 80 and 82 are not in a planar, face-to-face relationship with traces 106 and 107. This non-overlapping arrangement reduces possible undesirable coupling between these traces. Moreover, the conductive material of layers 93 and 97 further tend to shield traces 80 and 82 from traces 106 and 107. Also the conductive material of layer 78 shields traces 80 and 82 from each other and traces 106 and 107 are shielded from each other by the conductive material of layer 99. More specifically, as shown in FIG. 4, ground plane portion 118 surround portions of traces 80 and 82. Ground plane portions 120 and 122 surround respective spirals 90 and 98. Ground plane portion 124 surround portions of traces 106 and 107.Such shielding and positioning of the traces thus tend to reduce undesired parasitic coupling, which would otherwise occur. Such parasitic coupling would have an undesirable effect on the coupling sensitivity characteristics of coupler 70.

FIG. 9 shows a cross section of members 72 and 74 along axis 81 of FIG. 5. Exemplary plated through conductor 116 connects terminal 86 of tab 81 to terminal 88 of coil 90. Conductor 88 lies along axis 91 of FIG. 4 and extends through hole 95 in substrate layer 94. Cross sections are shown in FIG. 9 of coil 90 and ground planes 118 and 120 of respective layers 78 and 93. Similarly, it will be apparent to those skilled in the art that other cross sections can also be taken along axes 83, 109 and 110 to reveal other plated through conductors for respectively connecting terminals 87 and 89; 103 and 100; and,105 and 100.

Tabs 80 and 82 of FIG. 5 can respectively facilitate connection to the input and output ports of the main signal line 90. Other strip line or micro-strip traces can be employed to electrically connect tab 80 to transmitter output 16 of FIG. 1 and tab 82 to an rf connector connected to an antenna coaxial cable 26 of FIG. 1 for instance. Tabs or traces 106 and 107 can respectively provide connection to the forward port 28 and the reverse port 36.

Alternatively, because of symmetrical nature of coupler 70, tabs 80 and 82 could be connected to the auxiliary line ports and tabs 106 and 107 could be connected to the main line ports.

Tabs 80, 82, 106 and 107 have predetermined widths and spacing from their adjacent ground planes which determine the impedances at the ports of coupler 70. It is desirable to arrange the configurations of tabs 80, 82, 106 and 107 so that impedances of 50 ohms are provided at these ports. All the planar layers of members 72, 74 and 76 are bonded together in a known manner to fabricate the strip line structure of coupler 70.

FIG. 10 shows a non-exploded view of spiral coupler 70 having members 72, 74 and 76. The thickness of dielectrics 94 and 113 of the bottom member 72 and top member 76 are 0.015 inch and the thickness of middle dielectric member 74 is 0.030 inch. The dielectric layers of coupler 70 can be made of FR-4. The foregoing dimensions are suitable for coupler 70 having a characteristic impedance of 50 ohms. Other thicknesses can be selected to provide characteristic impedances of other that 50 ohms.

Coupler 70 can be installed in a multi-layer circuit board which provides thin metal traces or conductors that are connected to the tabs in a known manner so that the forward and reverse signals are conducted by the main line of the coupler which induce feed back signals that are provided from the forward and reverse ports. These feedback signals can control various functions in a communication system and/or enable measurement of various parameters of an associated communication system.

Tabs 80, 82, 106 and 107 are located along respective axes 81, 83, 109 and 110 that are all at 90 degree angles to each other or are orthogonal with each other to proved the maximum area or room for making connection to the tabs by the external traces. This enables the structure of spiral coupler 70 to have minimal dimensions and thus minimum weight. FIG. 11 illustrates a top view of coupler 70. L3 and W3 of FIG. 11 are each 0.60 inch and H3 of FIG. 10 is 0.065 inch. Of course the type of materials used and dimensions of coupler 70 will depend on the bandwidth of interest. Thus coupler 70 is far smaller and than prior art couplers 10' and 10" of respective FIG. 2 and FIG. 3, for instance.

FIG. 12 is a top view of layers 97 and 93 showing the juxtaposition of spiral 98 (which is depicted by a dashed line) and spiral 90 (which is depicted by a solid line). Capacitive coupling provided by prior art face-to-face windings tend to undesirably increase the amount of coupling between the main and auxiliary windings as the frequency of operation increases. This increases the sensitivity of the coupler with frequency which requires the use of external frequency compensation especially for electrically short couplers such as coupler 70. The lengths and diameters of the spirals depend on the bandwidth of operation of coupler 70. As shown spirals 90 and 98 tend to cross over each other at points 125 and 127 and are not aligned with each other at all points to thereby provide increased inductive coupling between the spirals. This inductive coupling tends to enhance the operating characteristics of coupler 70 by providing a coupling sensitivity which tends to remain flat as the frequency of operation over the bandwidth increases.

More specifically, the graph of FIG. 13 includes abscissa axis 128 for measuring frequencies between 105 MHz and 155 MHz and ordinate axis 129 for measuring decibels (dB) of attenuation at forward monitoring port 28 of FIG. 1. Reference axis 130 indicates the signal level between the main line terminals 22 and 26 of FIG. 1 with respect to ground, when coupler 70 is connected as coupler 10 of FIG. 1. Graph 131 indicates the attenuation of the resulting forward signal at port 28 as a function of the frequency of the main signal being conducted between ports 20 and 22. For instance the forward coupling attenuation is approximately 22 dB at 137 MHz as indicated by point 132. The aviation band of interest for coupler 70 is 112 to 151 MHz. Thus it will be appreciated by one skilled in the art that characteristic 131 shows that the sensitivity of coupler 70 rises only a desirable amount over the band of interest.

The graph of FIG. 14 includes abscissa axis 133 and ordinate axis 134 for measuring dB of attenuation at reverse monitoring port 36 of FIG. 1. Again, reference axis 136 indicates the signal level at main line terminals 22 and 26 of FIG. 1 with respect to ground when coupler 70 is connected as coupler 10. Graph 138 indicates the attenuation of the resulting forward signal at port 36 as a function of the frequency of the main signal between ports 20 and 22. For instance the reverse coupling attenuation is approximately 44 dB at 137 MHz as indicated by point 126. Thus the difference between the forward and reverse coupling is approximately 22 dB which is an excellent figure of merit as will be appreciated by those skilled in the art.

It will also be appreciated by those skilled in the art that desirable characteristics 131 and 138 stem from the reduction of undesirable parasitic coupling between the traces and the maximization of inductive coupling between spiral coils 90 and 98 as has been described.

From the foregoing detailed description of a preferred exemplary embodiment, it should be appreciated that coupler structure 70 has been described which takes up minimal space and has minimal weight. Coupler 70 is therefore suitable for permanent installation in aviation and portable communication products. Coupler 70 as a minimum insertion loss and a maximum coupling efficiency. Furthermore, coupler 70 has a relatively flat or constant coupling sensitivity over the bandwidth of operation. The desirable characteristics of coupler 70 are due at least in part to enhanced inductive coupling and the reduction of unwanted parasitic coupling. The ruggedized structure of disclosed coupler 70 requires no hand placed or special vendor supplied parts and the structure is easy to manufacture.

While a preferred exemplary embodiment has been presented in the foregoing detailed description, it should be appreciated that a vast number of variations thereof exist. For instance although couple 70 has been described as a bidirectional coupler, coupler 70 could be utilized as a unidirectional coupler by terminating one of the auxiliary terminals thereof in a manner well known in the art. It should also be appreciated that the preferred exemplary embodiment is only an example, and is not intended to limit the scope, applicability, or configuration of the invention in any way. Rather, the ensuing detailed description will provide those skilled in the art with a convenient map for implementing a preferred embodiment of the invention. It being understood that various changes may be made in the function and arrangement of the elements described in the exemplary preferred embodiment without departing from the spirit and scope of the invention as set forth in the appended claims.

What is claimed is:

1. A directional coupler comprising:

a first member having a first layer, a second layer and a substrate layer disposed between said first and second layers; a first conductive trace disposed along a first axis on said first layer and a second conductive trace disposed along a second axis on said first layer; a first signal line provided on said second layer; said first signal line being connected to said first trace and to said second trace;

a second member having a third layer, a fourth layer and a further substrate layer disposed between said third and fourth layers; a third conductive trace disposed along a third axis on said third layer and a fourth conductive trace disposed along a fourth axis on said third layer; a second signal line provided on said fourth layer, said second signal line being connected to said third trace and to said fourth trace;

insulating member having opposite planar sides; and said first and said second signal lines being juxtapositioned on said opposite planar sides of said insulating member to enable a signal on said first signal line to be inductively coupled onto said second signal line.

2. The directional coupler of claim 1 wherein said first and second axes are along straight lines that are at a 90-degree angle with respect to each other.

3. The directional coupler of claim 1 wherein said second and third axes are each along straight lines that are at a 90-degree angle with respect to each other.

4. The directional coupler of claim 1 wherein said first, second third and fourth axes are each along straight lines that are all at 90 degree angles with respect to each other to facilitate miniaturization of the directional coupler.

5. The directional coupler of claim 1 wherein said first layer includes a ground plane surrounding at least a portion of said first trace to shield said first and second traces from each other.

6. The directional coupler of claim 1 wherein said second layer includes a ground plane surrounding at least a portion of said first signal line to shield at least one of said first and second traces from at least one of said third and fourth traces.

7. The directional coupler of claim 1 wherein said third layer includes a ground plane surrounding at least a portion of said third trace to shield said third trace and said fourth trace from each other.

8. The directional coupler of claim 1 wherein said fourth layer includes a ground plane surrounding at least a portion of said second signal line to shield at least one of said first and second traces from at least one of said third and fourth traces.

9. The directional coupler of claim 1 wherein:

each of said first and second traces have an end portion, said first signal line having a first end and a second end, said first and second ends of said first signal line being respectively aligned with and connected through said substrate layer to said end portions of said first and second traces; and each of said third and fourth traces have an end portion, said second signal line having a first end and a second end, said first and second ends of said first signal line being respectively aligned with and connected through said further substrate layer to said end portions of said third and fourth traces.

10. The directional coupler of claim 1 wherein:

said first signal line is in the shape of a first spiral and said second signal line is in the shape of a second spiral; and said first and second spirals are juxtapositioned to cross over each other to facilitate inductive coupling of said signal on said first signal line to said second signal line.

11. A layered miniature directional coupler including in combination:

a first insulating substrate having first and second planar surfaces;

a first conductive layer affixed to said first planar surface;

a second conductive layer affixed to said second planar surface;

said first conductive layer having a first conductive trace extending along a first axis and a second conductive trace extending along a second axis, each of said first and second conductive traces having an end portion;

said second conductive layer having a first conductive spiral having a first end and a second end; said first end of said first spiral being aligned with and connected through said first substrate to said end portion of said first trace and said second end of said first spiral being aligned with and connected through said first substrate to said end portion of said second trace;

a second insulating substrate having first and second planar surfaces;

a third conductive layer affixed to said first planar surface of said second substrate;

a fourth conductive layer affixed to said second planar surface of said second substrate;

said third conductive layer having a third conductive trace along a third axis and a fourth conductive trace along a fourth axis, each of said third and fourth conductive traces having an end portion;

said fourth conductive layer having a second conductive spiral having a first end and a second end; said first end of said second spiral being aligned with and connected through said second substrate to said end portion of said third trace and said second end of said second spiral being aligned with and connected through said second substrate to said end portion of said fourth trace;

a center substrate having a first surface affixed to said first spiral and a second surface affixed to said second spiral, said spirals thereby being juxtapositioned to enable a signal conducted by said first spiral to be coupled to said second spiral; and said first and second axes being at a 90-degree angle to each other, said second and third axes being at a 90-degree angle to each other, and said third and fourth axes being at a 90-degree angle with respect to each other to enable the directional coupler to have minimized length and width dimensions.

12. The directional coupler of claim 11 wherein said first and second spirals are juxtapositioned to cross over each other to facilitate inductive coupling of a signal on said first spiral onto said second spiral.

13. The directional coupler of claim 11 wherein said second conductive layer includes a ground plane surrounding at least a portion of said first spiral.

14. The directional coupler of claim 11 wherein said first conductive layer includes a ground plane surrounding at least a portion of said second trace.

15. The directional coupler of claim 11 wherein said fourth conductive layer includes a ground plane surrounding at least a portion of said second spiral.

16. The directional coupler of claim 11 wherein:

said first trace, said second trace and said first spiral form a main signal line for conducting at least one primary signal; and said third trace, said fourth trace and said second spiral form an auxiliary signal line for monitoring said primary signal on said main signal line.

17. The directional coupler of claim 16 wherein:

said main signal line conducts a forward signal; and said third trace facilitates the monitoring of said forward signal.

18. The directional coupler of claim 16 wherein:

said main signal line conducts a reverse signal and said fourth trace facilitates the monitoring of said reverse signal.

19. The directional coupler of claim 11 suitable for operating in the frequency range of substantially 55 Megahertz to 155 Megahertz having a length and width of substantially 0.6 inch and a height of substantially 0.065 inch.

* * * * *